US008909103B2

(12) United States Patent
Shigezaki et al.

(10) Patent No.: US 8,909,103 B2
(45) Date of Patent: Dec. 9, 2014

(54) IMAGE FORMING APPARATUS

(71) Applicant: Fuji Xerox Co., Ltd., Minato-ku, Tokyo (JP)

(72) Inventors: Satoshi Shigezaki, Kanagawa (JP); Yasutaka Matsumoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 65 days.

(21) Appl. No.: 13/665,095

(22) Filed: Oct. 31, 2012

(65) Prior Publication Data

US 2013/0195508 A1 Aug. 1, 2013

(30) Foreign Application Priority Data

Jan. 31, 2012 (JP) ..... 2012-018804

(51) Int. Cl.
*G03G 15/01* (2006.01)

(52) U.S. Cl.
USPC ..... 399/223; 399/227

(58) Field of Classification Search
USPC ..... 399/223
See application file for complete search history.

(56) References Cited

U.S. PATENT DOCUMENTS

| | | | | |
|---|---|---|---|---|
| 6,077,636 | A * | 6/2000 | Moriki et al. | 430/45.54 |
| 2001/0006755 | A1 * | 7/2001 | Itami et al. | 430/59.5 |
| 2011/0236043 | A1 | 9/2011 | Masui | |

FOREIGN PATENT DOCUMENTS

| | | | |
|---|---|---|---|
| JP | 06-222645 | A | 8/1994 |
| JP | 2009-080436 | A | 4/2009 |

* cited by examiner

*Primary Examiner* — Clayton E Laballe
*Assistant Examiner* — Jas Sanghera
(74) *Attorney, Agent, or Firm* — Sughrue Mion, PLLC

(57) ABSTRACT

An image forming apparatus includes a latent image carrier, a first developing unit, a second developing unit, a transfer unit, a removing member, and a fixing unit. An average circularity of particles having an average particle diameter of no less than 100 nm and no more than 300 nm among particles included in a second external additive is less than an average circularity of particles having an average particle diameter of no less than 100 nm and no more than 300 nm among particles included in a first external additive.

18 Claims, 4 Drawing Sheets

IMAGE FORMING APPARATUS

CROSS-REFERENCE TO RELATED APPLICATIONS

This application is based on and claims priority under 35 USC 119 from Japanese Patent Application No. 2012-018804 filed Jan. 31, 2012.

BACKGROUND

Technical Field

The present invention relates to an image forming apparatus.

SUMMARY

According to an aspect of the invention, there is provided an image forming apparatus including a latent image carrier that carries an electrostatic latent image; a first developing unit that develops the electrostatic latent image on the latent image carrier, the first developing unit containing a first external additive and first toner; a second developing unit that develops the electrostatic latent image on the latent image carrier, the second developing unit containing a second external additive and second toner; a transfer unit that transfers a toner image formed on a surface of the latent image carrier to a recording medium; a removing member that contacts the surface of the latent image carrier, and scrapes off any residual toner on the surface of the latent image carrier after the transfer of the toner image by the transfer unit; and a fixing unit that fixes the toner image on the recording medium to the recording medium. In the image forming apparatus, an average circularity of particles having an average particle diameter of no less than 100 nm and no more than 300 nm among particles included in the second external additive is less than an average circularity of particles having an average particle diameter of no less than 100 nm and no more than 300 nm among particles included in the first external additive.

BRIEF DESCRIPTION OF THE DRAWINGS

An exemplary embodiment of the present invention will be described in detail based on the following figures, wherein.

DETAILED DESCRIPTION

An exemplary embodiment of the present invention will hereunder be described with reference to the drawings.

Figure 1:
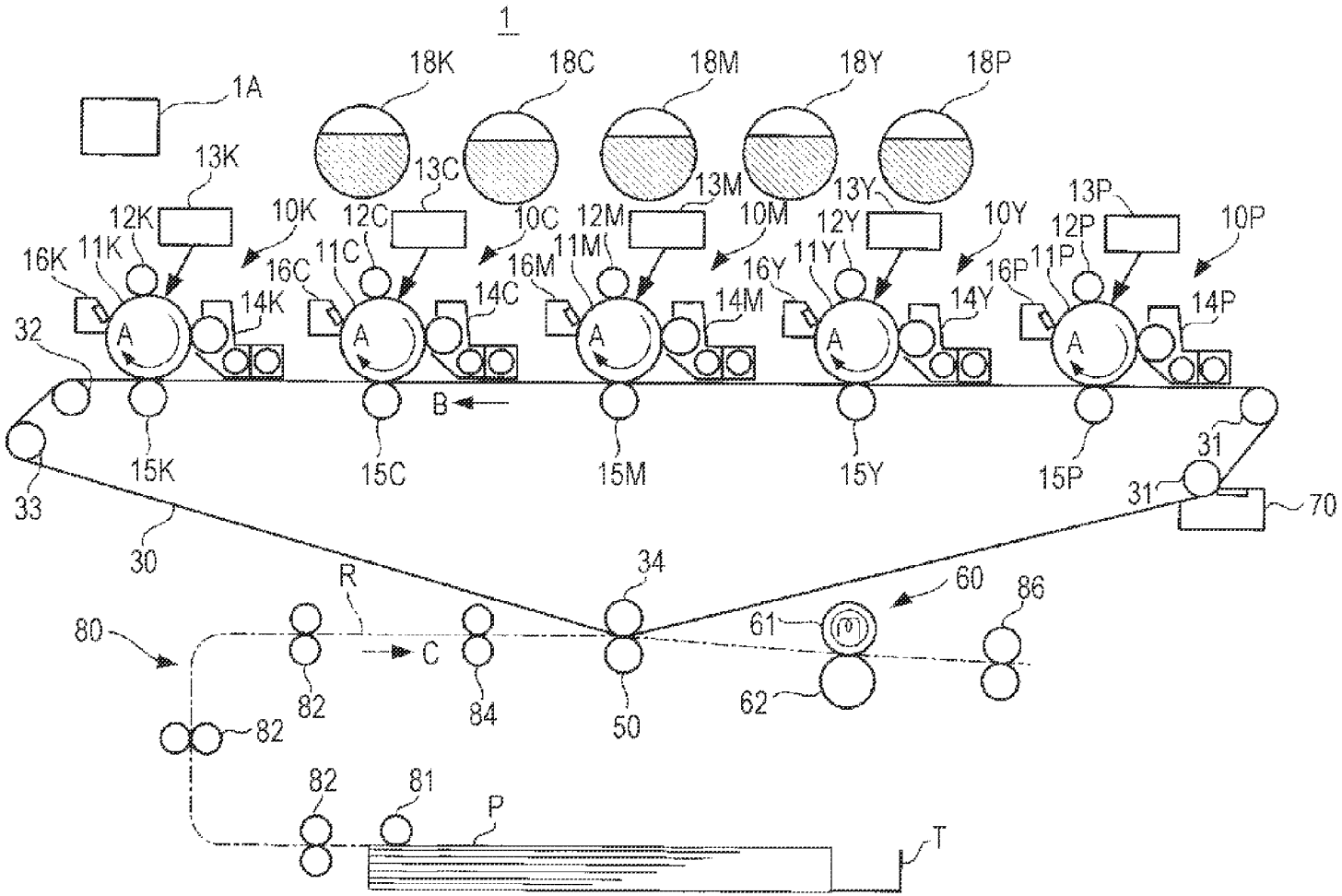
FIG. 1 illustrates the structure of an image forming apparatus according to an exemplary embodiment of the present invention.

FIG. 1 illustrates the structure of an image forming apparatus 1 according to an exemplary embodiment of the present invention.

The image forming apparatus 1 shown in FIG. 1 is a tandem color printer in which image forming units 10Y, 10M, 10C, and 10K for the corresponding colors, yellow (Y), magenta (M), cyan (C), and black (K), are disposed in parallel. The image forming apparatus 1 is capable of printing a full color image formed of toner images of four colors, in addition to a monochrome image. The image forming apparatus 1 also includes an option image forming unit 10P disposed in parallel with and at an uppermost stream side of the image forming units 10Y, 10M, 10C, and 10K of the corresponding colors, Y, M, C, and K. When the option image forming unit 10P is used by making it correspond to a color other than C, M, Y, and K, such as white, gold, or a clear color, the option image forming unit 10P achieves many different image representations regarding, for example, graininess, image fineness, emphasizing of relief, and measures taken with regard to embossed paper. In the exemplary embodiment, the option image forming unit 10P is made to correspond to a clear color.

The image forming apparatus 1 includes toner cartridges 18Y, 18M, 18C, 18K, and 18P containing toners of the colors, Y, M, C, and K and the color corresponding to the option image forming unit 10P.

The four image forming units 10Y, 10M, 10C, and 10K, and the option image forming unit 10P have similar structures (for example, have the same size and are formed of the same material) except that they use different developers. Therefore, the image forming unit 10Y corresponding to yellow will be described as a typical example of the image forming units. The image forming unit 10Y includes a photoconductor member 11Y, a charging unit 12Y, an exposing unit 13Y, a developing device 14Y, a first transfer unit 15Y, and a photoconductor-member cleaner 16Y. Excluding the exposing unit 13Y, these component parts constitute what is called a process cartridge. The process cartridges of the four image forming units 10Y, 10M, 10C, and 10K and the process cartridge of the option image forming unit 10P have a common structure.

The photoconductor member 11Y has a photoconductor layer formed on a circular cylindrical substrate. The photoconductor member 11Y carries an image formed on the surface thereof, and rotates in the direction of arrow A corresponding to a direction around a circular cylindrical shaft. The charging unit 12Y, the exposing unit 13Y, the developing device 14Y, the first transfer unit 15Y, and the photoconductor cleaner 16Y are sequentially disposed around the photoconductor member 11Y. The photoconductor member 11Y corresponds to an exemplary image carrying member in the present invention. A combination of the charging unit 12Y and the exposing unit 13Y corresponds to a latent image forming unit in the present invention. The developing device 14Y corresponds to an exemplary developing unit in the present invention. The developing unit corresponding to a clear color corresponds to an exemplary first developing unit in the present invention. The developing units corresponding to the colors, Y, M, C, and K, correspond to exemplary second developing units in the present invention.

The charging unit 12Y charges the surface of the photoconductor member 11Y. The charging unit 12Y in the exemplary embodiment is a charging roller that contacts the surface of the photoconductor member 11Y. A voltage having the same polarity as a toner charging polarity in the developing device 14Y is applied to the charging roller. The charging roller charges the surface of the photoconductor member 11Y with which the charging roller contacts. In addition to the charging roller, for example, a corona discharger that does not contact the photoconductor member 11Y may be used as the charging unit 12Y.

The exposing unit 13Y includes a light-emitting unit and a rotating polygonal mirror. The light-emitting unit emits laser light based on an image signal supplied from the outside of the image forming apparatus 1. The rotating polygonal mirror is used for scanning the photoconductor member 11Y with laser light. By irradiating the photoconductor member 11Y with the laser light, the surface of the photoconductor member 11Y is exposed. In addition to a system using laser light, for example, an LED array (including light-emitting diodes (LEDs) disposed side by side along a scanning direction) may also be used as the exposing unit 13Y. Further, in addition to an exposing system, for example, a system that directly forms a latent image using electrodes that are disposed side by side along the scanning direction may also be used as the latent image forming unit.

The developing device 14Y develops the latent image on the surface of the photoconductor member 11Y using a two-component developer containing toner and magnetic carriers. As described below, a substance called an external additive is mixed in the two-component developer. Along with the external additive, toner is supplied to the developing device 14Y from the toner cartridge 18Y. The toner is mixed with the magnetic carriers in the developing device 14Y. In the magnetic carriers, for example, surfaces of iron powder are coated with resin. Toner particles are formed of, for example, binding resin, a coloring agent, or a separating agent. For example, materials of the external additive will be described in detail below. The developing device 14Y stirs the developer in which magnetic carrier particles and the toner particles are mixed with each other, to charge the toner and the magnetic carriers, so that the surface of the photoconductor member 11Y is subjected to development using the charged toner.

The first transfer unit 15Y is a roller that opposes the photoconductor member 11Y with an intermediate transfer belt 30 being disposed therebetween. The first transfer unit 15Y has a conductive elastic layer on its surface. By applying a voltage having a polarity that is opposite to the toner charging polarity to the first transfer unit 15Y, a toner image on the photoconductor member 11Y is electrostatically attracted to the intermediate transfer belt 30. The photoconductor-member cleaner 16Y includes a cleaning blade that contacts the surface of the photoconductor member 11Y, and cleans the surface of the photoconductor member 11Y after the transfer. More specifically, any residual toner on the surface of the photoconductor member 11Y and any external additive on the surface of the photoconductor member 11Y that has separated from the toner are scraped off by the cleaning blade. The cleaning blade corresponds to an exemplary removing member in the present invention.

The image forming apparatus 1 also includes the intermediate transfer belt 30, a fixing device 60, a sheet transporting unit 80, and a controller 1A that controls each portion of the image forming apparatus 1. The intermediate transfer belt 30 is an endless belt formed of resin material containing a conductant agent. The intermediate transfer belt 30 is placed upon belt support rollers 31 to 35. The intermediate transfer belt 30 circulates in the direction of arrow B along the option image forming unit 10P, the image forming units 10Y, 10M, 10C, and 10K, and a second transfer unit 50. Toner images of the corresponding colors are transferred to the intermediate transfer belt 30 from the option image forming unit 10P and the image forming units 10Y, 10M, 10C, and 10K. The intermediate transfer belt 30 carries the toner images of the corresponding colors, and moves.

The second transfer unit 50 is a roller that rotates with a sheet and the intermediate transfer belt 30 being disposed between the second transfer unit 50 and the backup roller 34 serving as one of the belt support rollers 31 to 35. In the second transfer unit 50, a conductive elastic layer is formed on its surface. By applying a voltage having a polarity that is opposite to the toner charging polarity to the second transfer unit 50, the toner images on the intermediate transfer belt 30 are electrostatically attracted to a sheet. A combination of the first transfer unit 15Y, the intermediate transfer belt 30, and the second transfer unit 50 corresponds to an exemplary transfer unit in the present invention. As the transfer unit, a direct transfer type that directly transfers the toner images to a sheet from the option image forming unit 10*p* and the image forming units 10Y, 10M, 10C, and 10K may also be used.

A belt cleaner 70 scrapes off any toner on the intermediate transfer belt 30 by bringing a blade into contact with the intermediate transfer belt 30.

The fixing device 60 fixes the toners to the sheet. The fixing device 60 includes a heating roller 61 and a pressure roller 62. A heater is built in the heating roller 61. The heating roller 61 and the pressure roller 62 fix the toner images to the sheet by allowing the sheet having the unfixed toner images formed thereon to pass between the heating roller 61 and the pressure roller 62. The fixing device 60 corresponds to an exemplary fixing unit in the present invention. In addition to a system in which the fixing unit is separated from the transfer unit, a system in which the fixing unit and the transfer unit are integrated to each other and the transfer and the fixing are performed at the same time may also be used.

The sheet transporting unit 80 includes a take-out roller 81, flip-through rollers 82, a transport roller 83, registration rollers 84, and discharge rollers 86. The take-out roller 81 takes out sheets held in a sheet container T. The flip-through rollers 82 are used for flipping through the sheets that have been taken out. The transport roller 83 transports the sheets. The registration rollers 84 transport the sheets to the second transfer unit 50. The discharge rollers 86 discharge the sheets to the outside. The sheet transporting unit 80 transports the sheets along a sheet transport path R through the second transfer unit 50 and the fixing device 60.

A basic operation of the image forming apparatus 1 shown in FIG. 1 will be described. At the yellow image forming unit 10Y, the photoconductor member 11Y is rotationally driven in the direction of arrow A, and the surface of the photoconductor member 11Y is electrically charged by the charging unit 12Y. The exposing unit 13Y irradiates the surface of the photoconductor member 11Y with exposure light based on an image signal corresponding to yellow among image signals supplied from the outside, to form an electrostatic latent image on the surface of the photoconductor member 11Y. The developing device 14Y develops the electrostatic latent image with toner, to form a toner image. Yellow toner is supplied to the developing device 14Y from the toner cartridge 18Y not only at the same time as the development. It is supplied at all times from the toner cartridge 18Y. The photoconductor member 11Y carries the yellow toner image formed on the surface thereof, and rotates. The toner image formed on the surface of the photoconductor member 11Y is transferred to the intermediate transfer belt 30 by the first transfer unit 15Y. After the transfer, any toner remaining on the photoconductor member 11Y is collected and removed by the photoconductor cleaner 16Y.

The intermediate transfer belt 30 is placed upon the support rollers 31 to 35, and circulates in the direction of arrow B. Similarly to the yellow image forming unit 10Y, the image forming units 10M, 10C, and 10K corresponding to the colors other than yellow form toner images of the colors corresponding to the image forming units, so that the toner images of the corresponding colors are transferred to the intermediate transfer belt 30 so as to be superimposed upon the toner image transferred at the yellow image forming unit 10Y.

At the uppermost stream option image forming unit 10*p*, a clear toner image is formed on the Y, M, C, and K toner images by exposure light based on an option image signal (such as a signal indicating a form of relief). The clear toner image is previously transferred to a location on the intermediate transfer belt 30 where the Y, M, C, and K toner images are later superimposed and transferred. Therefore, the Y, M, C, and K toner images and the clear toner image are superimposed upon each other on the intermediate transfer belt 30.

A sheet P is taken out from the sheet container T by the take-out roller 81. The transport roller 83 and the registration rollers 84 transport the sheet P along the sheet transport path R in the direction of arrow C towards the second transfer unit 50. The registration rollers 84 send the toner images to the second transfer unit 50 on the basis of a timing in which the toner images are transferred to the intermediate transfer belt 30. By applying a transfer voltage to a location between the intermediate transfer belt 30 and the sheet P, the second transfer unit 50 transfers the toner images on the intermediate transfer belt 30 to the sheet P. The sheet P to which the toner images have been transferred is transported to the fixing device 60 from the second transfer unit 50, and the toner images transferred to the sheet are fixed. In this way, an image is formed on the sheet. The sheet on which the image has been formed is discharged to the outside of the image forming apparatus 1 by the discharge rollers 86. After the transfer by the second transfer unit 50, any toner remaining on the intermediate transfer belt 30 is removed by the belt cleaner 70.

Here, the developing device will be described.

Figure 2:
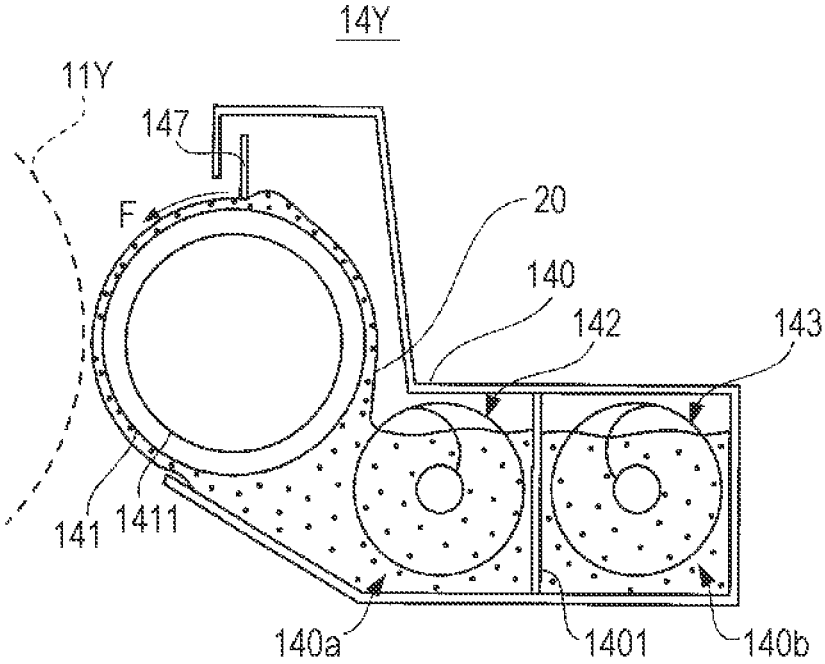
FIG. 2 is a sectional view of a developing device shown in FIG. 1.

FIG. 2 is a sectional view of the developing device shown in FIG. 1.

FIG. 2 shows the yellow developing device 14Y. The developing devices 14M to 14K for the other colors also have the same structure as the yellow developing device 14Y.

The developing device 14Y includes a developer container 140, a developing roller 141, a first stirring transporting member 142, a second stirring transporting member 143, and a layer regulating member 147.

The developer container 140 contains in an internal portion thereof developer 20 including toner, magnetic carriers, and an external additive. The internal portion of the developer container 140 is partitioned into a first chamber 140*a* and a second chamber 140*b* by a partition wall 1401. The first chamber 140*a* is disposed next to the developing roller 141. The second chamber 140*b* is disposed opposite the developing roller 141 with the first chamber 140*a* being disposed therebetween.

The first stirring transporting member 142 is disposed in the first chamber 140*a*. The second stirring transporting member 143 is disposed in the second chamber 140*b*. The two stirring transporting members 142 and 143 extend in a direction in which the developing roller 141 extends (that is, towards a far side in FIG. 2), and each include a rotary shaft extending parallel to the developing roller 141 and a helical blade provided along the rotary shaft. The developing roller 141 and the two stirring transporting members 142 and 143 rotate as a result of being driven by a motor (not shown).

The first stirring transporting member 142 rotates to transport and stir the developer 20 in the first chamber 140*a* towards the far side in FIG. 2. The second stirring transporting member 143 rotates to transport the developer 20 in the second chamber 140*b* in a direction opposite to the direction of transport in the first chamber 140*a*. Since the length of the partition wall 1401 in the far-side direction in FIG. 2 is less than the length of the developer container 140, connecting openings that connect the first chamber 140*a* and the second chamber 140*b* are formed in respective ends of the partition wall 1401. The developer 20 in the developer container 140 circulates in the first chamber 140*a* and the second chamber 140*b* through the connecting openings. By transporting and stirring the developer 20 in this way, the developer 20 behaves like a fluid in which the toner, the external additive, and the magnetic carriers are blended with each other.

The developing roller 141 transports the developer from the developer container 140 to the surface of the photoconductor member 11Y (see FIG. 1). The developing roller 141 has a circular cylindrical shape, and has a magnet 1411 disposed in an internal portion thereof. The magnet 1411 is secured to the developer container 140. The magnet 1411 has a pickup magnetic pole for attracting to the developing roller 141 the magnetic carriers to which toner particles adhere, and a magnetic pole that causes the developer to stand in the form of a chain in a development area.

The developing roller 141 rotates while carrying the developer on its surface to transport the developer to the surface of the photoconductor member 11Y. The toner included in the developer transported to the surface of the photoconductor member 11Y adheres to a portion of the surface of the photoconductor member 11Y that has been irradiated with light. At this time, along with the toner, the external additive also adheres to the surface of the photoconductor member 11Y. The toner and the magnetic carriers that have not adhered to the photoconductor member 11Y are carried by the developing roller 141 and are returned to the first chamber 140*a*. An amount of toner corresponding to the amount of toner consumed in the development is supplied to the developer container 140 from the toner cartridge 18Y (see FIG. 1). An external additive adheres to the toner that is supplied in this way.

External additives are caused to adhere to the toner to fulfill various roles, typical roles being, for example, stabilizing the fluidity and chargeability of the toner, improving a toner-image transfer property, and properly polishing the surfaces of the photoconductor members. The external additive content is one that is in accordance with these purposes. Multiple types of external additives having volume mean particle diameters that are in accordance with the purposes are often mixed. For example, an external additive having a volume mean particle diameter of no less than 100 nm and no more than 300 nm is used for improving transfer property and stabilizing, for example, chargeability of toner by the action of a roller; or an external additive having a volume mean particle diameter of on the order of 500 nm is used for polishing the photoconductor members. Further, for example, an external additive having a volume mean particle diameter on the order of 50 nm is used for improving transfer property and stabilizing, for example, chargeability of toner by covering a toner surface. External additives are formed of materials that are in accordance with the purposes. For example, silica ($SiO_2$) or $TiO_2$ is used for the external additive for stabilizing, for example, the chargeability of toner, and other inorganic materials are used for the external additive for polishing the photoconductor members.

In particular, when emphasizing relief or taking measures with regard to embossed paper as when using clear toner, toner of a color corresponding to the option image forming unit 10P needs to be used in a larger amount than toners of other colors on a sheet. Therefore, the volume mean particle diameter of the toner of the color corresponding to the option image forming unit 10P is greater than the volume mean particle diameters of the toners of the other colors (that is, Y, M, C, and K in the exemplary embodiment). In the exemplary embodiment, for example, the volume mean particle diameter of the toners corresponding to Y, M, C, and K is 4.5 μm, and the volume mean particle diameter of the toner of the clear color corresponding to the option image forming unit 10P is 6.0 μm.

Here, the mixed state of the toner and the external additive in the developer contained in the developing unit will be described in detail. However, here, a description will be given, while focusing on, among the various types of external additives, an external additive having a volume mean particle diameter of no less than 100 nm and no more than 300 nm and used for stabilizing, for example, toner chargeability.

Figure 3:
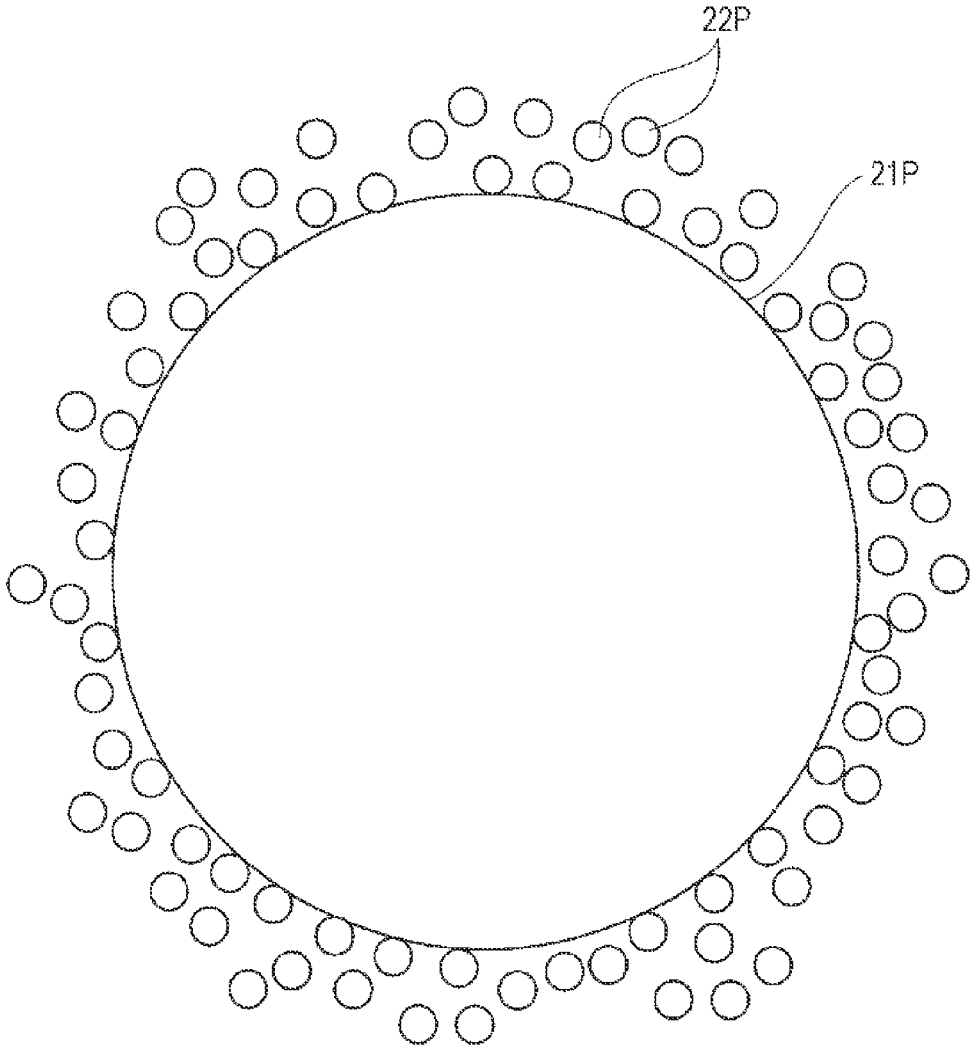
FIG. 3 is a conceptual diagram showing a mixed state of an external additive and toner in developer contained in a developing unit of an option image forming unit.

FIG. 3 is a conceptual diagram showing a mixed state of an external additive and toner in developer (hereunder referred to as "option developer" for the sake of simplifying the description) contained in a developing unit 14P of the option image forming unit 10P.

Figure 4:
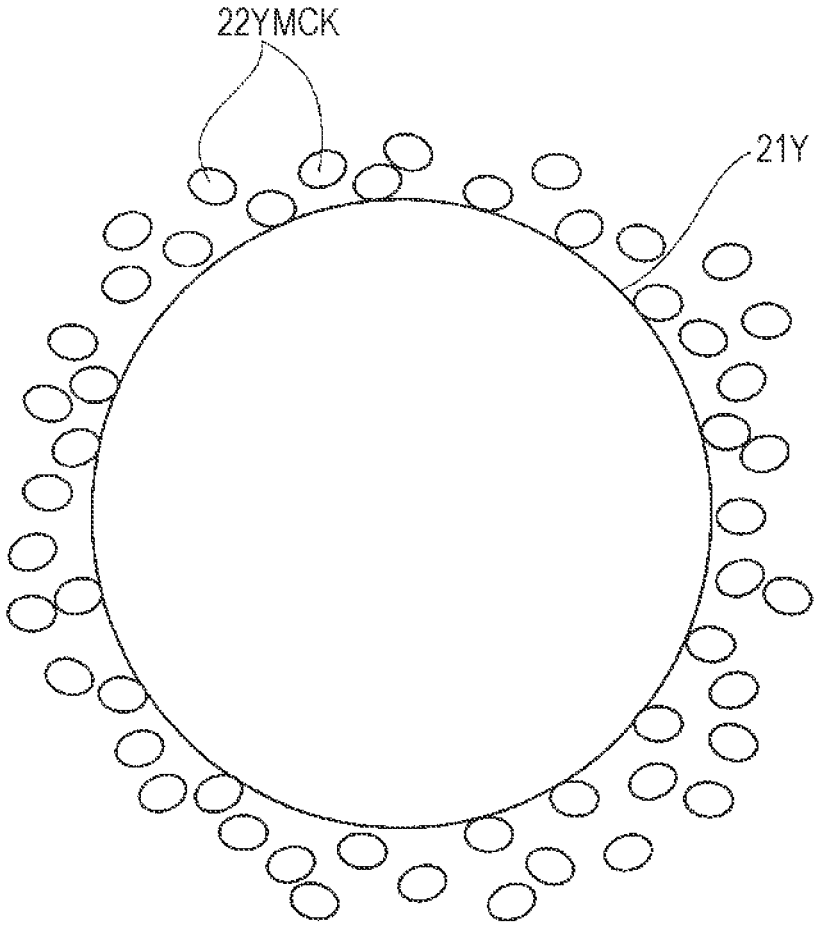
FIG. 4 is a conceptual diagram showing a mixed state of an external additive and toner in yellow developer typifying developers of corresponding colors, Y, M, C, and K.

FIG. 4 is a conceptual diagram showing a mixed state of an external additive and toner in yellow developer typifying developers of corresponding colors, Y, M, C, and K.

The option developer contained in the developing unit 14P of the option image forming unit 10P includes clear toner 21P and an external additive 22P. The volume mean particle diameter of the clear toner 21P is 6.0 μm, and the volume mean particle diameter of the external additive 22P is no less than 100 nm and no more than 300 nm.

The yellow developer includes yellow toner 21Y and an external additive 22YMCK. The toners included in the developers of the corresponding colors Y, M, C, and K are obviously toners of the corresponding colors. However, external additives in the developers of the corresponding colors Y, M, C, and K are common external additives 22YMCK. The volume mean particle diameters of the yellow toner 21Y and toners corresponding to M, C, and K are 4.5 μm, and the volume mean particle diameter of the external additive 22YMCK is no less than 100 nm and no more than 300 nm.

The volume mean particle diameter of the external additive 22P included in the option developer and that of the external additive 22YMCK included in the yellow developer are about the same because they are mixed for the same purpose. However, the circularity of the external additive 22P included in the option developer and that of the external additive 22YMCK included in the yellow developer differ from each other. That is, the circularity of the additive 22P included in the option developer is on the order of 0.93, and the circularity of the external additive 22YMCK included in the yellow developer is on the order of 0.75. Accordingly, the shape of the external additive 22P included in the option developer is closer to a circle (a sphere) than the shape of the external additive 22YMCK included in the yellow developer.

Here, the circularity is a value calculated by the following formula. If the particles have the shape of a circle (a sphere), the circularity is 1. As the shape of the particles diverges from the shape of a circle (a sphere), the circularity becomes a smaller value.

circularity=circumferential length of circle corresponding to particle projection area/circumferential length of particle projection image=[2×(particle projection area×π)^½]/circumferential length of particle projection image As a method of adjusting the circularity of particles, other existing methods are known. Here, any of these methods may be used. Therefore, detailed descriptions thereof will not be given.

For external additives having a volume mean particle diameter of no less than 100 nm and no more than 300 nm, using external additives having different circularities as mentioned above means that the average circularities differ in the range of particle diameter of no less than 100 nm and no more than 300 nm for mixtures of various types of external additives included in the developer.

For external additives having a volume mean particle diameter of no less than 100 nm and no more than 300 nm, due to the purposes for which they are mixed, the external additive content is in accordance with the surface area of the toner. When the external additive content becomes such an external additive content, the amount of entry of external additive into the photoconductor cleaner of the yellow image forming unit and the amount of entry of external additive into the photoconductor cleaner of the option image forming unit differ from each other. That is, the amount of entry of the external additive at the yellow image forming unit that uses toner having a relatively small particle diameter is greater than the amount of entry of the external additive at the option image forming unit that uses toner having a relatively large particle diameter.

If the circularity of the external additive in the yellow image forming unit and the circularity of the external additive in the option image forming unit are the same, the external additive tends to escape from the blade at the yellow image forming unit having a large amount of entry. This tends to cause taint damage of the charging unit and poor image quality. In contrast, at the option image forming unit having a small amount of entry, the cleaning blade is not sufficiently lubricated, as a result of which edge chipping and blade hold over tend to occur. In either case, the ability of the cleaning blade to clean off any residual toner and external additive is reduced.

In contrast, in the exemplary embodiment, the circularity of the external additive at the yellow image forming unit having a large external-additive entry amount is small, so that the cleaning blade has a high damming performance, thereby suppressing the escaping of the external additive from the blade. As a result, the occurrence of taint damage of the charging unit and the occurrence of improper image quality are reduced. In addition, since the circularity of the external additive at the option image forming unit having a small external-agent entry amount is high, the lubricating ability at the edge of the cleaning blade is high due to the operation of the roller, so that edge chipping and blade hold over are suppressed. That is, the ability of the cleaning blade to clean off any residual toner and external additive at the yellow image forming unit and the ability of the cleaning blade to clean off any residual toner and external additive at the option image forming unit are stabilized.

The circularities of other external additives whose particle diameters fall outside the range of no less than 100 nm and no more than 300 nm are about the same in all of the developing devices. This is because, for external additives whose particle diameters are less than 100 nm, almost no damming up of the external additives occurs at the cleaning blades regardless of the circularities of the external additives, and, for external additives whose particle diameter exceeds 300 nm, damming up of almost all of the external additives occurs at the cleaning blades regardless of the circularities of the external additives.

In addition to the method of changing the circularity of an external additive as described above, a method of changing, for example, the sizes or materials of the photoconductor cleaners may also be used as a method of stabilizing cleaning ability. However, when, for example, the sizes or materials of the photoconductor cleaners are changed, the commonness of the process cartridges is lost. This may influence the design and fabrication, as a result of which costs may increase. In contrast, for the developers, toners having different colors and particle diameters are originally used for the option developer and the Y, M, C, and K developers. Therefore, even if different external additives are used, the influence resulting therefrom is small, so that merits resulting from the commonness of the process cartridges are high.

Although, in the exemplary embodiment described above, what is called a tandem system including image carrying members is taken as an example, the image forming apparatus according to the present invention may be what is called a rotary image forming apparatus that forms toner images of multiple colors on one image carrying member. In this case, for all of the toner images of multiple colors formed on one image carrying member, any residual toner and external additive are cleaned off by one cleaner, so that it is particularly desirable that the circularities of the external additives be in accordance with the toner particle diameters.

Although, in the foregoing description, a printer is used as an exemplary image forming apparatus, the image forming apparatus according to the present invention may be a facsimile, a copying machine, or a multifunction apparatus.

Although, in the foregoing description, a color image forming apparatus using a clear toner as what is called a first toner in the present invention and using toners of corresponding colors, C, M, Y, and K as what are called second toners in the present invention is used, the image forming apparatus according to the present invention may be a monochrome image forming apparatus using clear toner as first toner and black toner as second toner. Further, the image forming apparatus according to the present invention may be an apparatus using C, M, and Y toners as first toners, and black toner as second toner.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a latent image carrier that carries an electrostatic latent image;

a first developing unit that develops the electrostatic latent image on the latent image carrier, the first developing unit containing a first external additive and first toner;

a second developing unit that develops the electrostatic latent image on the latent image carrier, the second developing unit containing a second external additive and second toner;

a transfer unit that transfers a toner image formed on a surface of the latent image carrier to a recording medium;

a removing member that contacts the surface of the latent image carrier, and scrapes off any residual toner on the surface of the latent image carrier after the transfer of the toner image by the transfer unit; and a fixing unit that fixes the toner image on the recording medium to the recording medium, wherein an average circularity of particles having an average particle diameter of no less than 100 nm and no more than 300 nm among particles included in the second external additive is less than an average circularity of particles having an average particle diameter of no less than 100 nm and no more than 300 nm among particles included in the first external additive.

2. The image forming apparatus according to claim 1, wherein the number of particles having the average particle diameter of no less than 100 nm and no more than 300 nm among the particles included in the second external additive is greater than the number of particles having the average particle diameter of no less than 100 nm and no more than 300 nm among the particles included in the first external additive.

3. The image forming apparatus according to claim 1, wherein the average particle diameter of the second toner is less than the average particle diameter of the first toner.

4. An image forming apparatus comprising:

a plurality of latent image carriers that carry electrostatic latent images, the plurality of latent image carriers including a first latent image carrier and a second latent image carrier;

a first developing unit that develops the electrostatic latent image on the first latent image carrier, the first developing unit containing a first external additive and first toner;

a second developing unit that develops the electrostatic latent image on the second latent image carrier, the second developing unit containing a second external additive and second toner;

a transfer unit that transfers a toner image formed on surfaces of the latent image carriers to a recording medium;

a removing member that contacts the surfaces of the latent image carriers, and scrapes off any residual toner on the surfaces of the latent image carriers after the transfer of the toner image by the transfer unit; and a fixing unit that fixes the toner image on the recording medium to the recording medium, wherein an average circularity of particles having an average particle diameter of no less than 100 nm and no more than 300 nm among particles included in the second external additive is less than an average circularity of particles having an average particle diameter of no less than 100 nm and no more than 300 nm among particles included in the first external additive.

5. The image forming apparatus according to claim 4, wherein the number of particles having the average particle diameter of no less than 100 nm and no more than 300 nm among the particles included in the second external additive is greater than the number of particles having the average particle diameter of no less than 100 nm and no more than 300 nm among the particles included in the first external additive.

6. The image forming apparatus according to claim 4, wherein the average particle diameter of the second toner is less than the average particle diameter of the first toner.

7. An image forming apparatus comprising:

a latent image carrier that carries an electrostatic latent image;

a first developing unit that develops the electrostatic latent image on the latent image carrier, the first developing unit containing a first external additive and first toner, the first external additive including at least $SiO_2$;

a second developing unit that develops the electrostatic latent image on the latent image carrier, the second developing unit containing a second external additive and second toner, the second external additive including at least $SiO_2$;

a transfer unit that transfers a toner image formed on a surface of the latent image carrier to a recording medium;

a removing member that contacts the surface of the latent image carrier, and scrapes off any residual toner on the surface of the latent image carrier after the transfer of the toner image by the transfer unit; and a fixing unit that fixes the toner image on the recording medium to the recording medium, wherein an average circularity of the $SiO_2$ included in the second external additive is less than an average circularity of the $SiO_2$ included in the first external additive.

8. The image forming apparatus according to claim 7, wherein the number of particles having an average particle diameter of no less than 100 nm and no more than 300 nm among particles included in the second external additive is greater than the number of particles having an average particle diameter of no less than 100 nm and no more than 300 nm among particles included in the first external additive.

9. The image forming apparatus according to claim 7, wherein an average particle diameter of the second toner is less than an average particle diameter of the first toner.

10. An image forming apparatus comprising:

a plurality of latent image carriers that carry electrostatic latent images, the plurality of latent image carriers including a first latent image carrier and a second latent image carrier;

a first developing unit that develops the electrostatic latent image on the first latent image carrier, the first developing unit containing a first external additive and first toner, the first external additive including at least $SiO_2$;

a second developing unit that develops the electrostatic latent image on the second latent image carrier, the second developing unit containing a second external additive and second toner, the second external additive including at least $SiO_2$;

a transfer unit that transfers a toner image formed on surfaces of the latent image carriers to a recording medium;

a removing member that contacts the surfaces of the latent image carriers, and scrapes off any residual toner on the surfaces of the latent image carriers after the transfer of the toner image by the transfer unit; and a fixing unit that fixes the toner image on the recording medium to the recording medium, wherein an average circularity of the $SiO_2$ included in the second external additive is less than an average circularity of the $SiO_2$ included in the first external additive.

11. The image forming apparatus according to claim 10, wherein the number of particles having an average particle diameter of no less than 100 nm and no more than 300 nm among particles included in the second external additive is greater than the number of particles having an average particle diameter of no less than 100 nm and no more than 300 nm among particles included in the first external additive.

12. The image forming apparatus according to claim 10, wherein an average particle diameter of the second toner is less than an average particle diameter of the first toner.

13. An image forming apparatus comprising:

a latent image carrier that carries an electrostatic latent image;

a first developing unit that develops the electrostatic latent image on the latent image carrier, the first developing unit containing a first external additive and first toner, the first external additive including at least $TiO_2$;

a second developing unit that develops the electrostatic latent image on the latent image carrier, the second developing unit containing a second external additive and second toner, the second external additive including at least $TiO_2$;

a transfer unit that transfers a toner image formed on a surface of the latent image carrier to a recording medium;

a removing member that contacts the surface of the latent image carrier, and scrapes off any residual toner on the surface of the latent image carrier after the transfer of the toner image by the transfer unit; and a fixing unit that fixes the toner image on the recording medium to the recording medium, wherein an average circularity of the $TiO_2$ included in the second external additive is less than an average circularity of the $TiO_2$ included in the first external additive.

14. The image forming apparatus according to claim 13, wherein the number of particles having an average particle diameter of no less than 100 nm and no more than 300 nm among particles included in the second external additive is greater than the number of particles having an average particle diameter of no less than 100 nm and no more than 300 nm among particles included in the first external additive.

15. The image forming apparatus according to claim 13, wherein an average particle diameter of the second toner is less than an average particle diameter of the first toner.

16. An image forming apparatus comprising:

a plurality of latent image carriers that carry electrostatic latent images, the plurality of latent image carriers including a first latent image carrier and a second latent image carrier;

a first developing unit that develops the electrostatic latent image on the first latent image carrier, the first developing unit containing a first external additive and first toner, the first external additive including at least $TiO_2$;

a second developing unit that develops the electrostatic latent image on the second latent image carrier, the second developing unit containing a second external additive and second toner, the second external additive including at least $TiO_2$;

a transfer unit that transfers a toner image formed on surfaces of the latent image carriers to a recording medium;

a removing member that contacts the surfaces of the latent image carriers, and scrapes off any residual toner on the surfaces of the latent image carriers after the transfer of the toner image by the transfer unit; and a fixing unit that fixes the toner image on the recording medium to the recording medium, wherein an average circularity of the $TiO_2$ included in the second external additive is less than an average circularity of the $TiO_2$ included in the first external additive.

17. The image forming apparatus according to claim 16, wherein the number of particles having an average particle diameter of no less than 100 nm and no more than 300 nm among particles included in the second external additive is greater than the number of particles having an average particle diameter of no less than 100 nm and no more than 300 nm among particles included in the first external additive.

18. The image forming apparatus according to claim 16, wherein an average particle diameter of the second toner is less than an average particle diameter of the first toner.

* * * * *